US007031631B2

(12) United States Patent
Sato et al.

(10) Patent No.: US 7,031,631 B2
(45) Date of Patent: Apr. 18, 2006

(54) IMAGE FORMING APPARATUS OPERABLE IN PLURAL MODES OF FORMING IMAGES ON INTERMEDIATE TRANSFER MEMBER

(75) Inventors: Akihiko Sato, Chiba (JP); Shinichi Takata, Chiba (JP); Shigemichi Hamano, Chiba (JP); Toru Ono, Ibaraki (JP); Kenji Morita, Ibaraki (JP); Yushi Oka, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 10/791,836

(22) Filed: Mar. 4, 2004

(65) Prior Publication Data

US 2004/0175209 A1 Sep. 9, 2004

(30) Foreign Application Priority Data

Mar. 7, 2003 (JP) ..... 2003-061906

(51) Int. Cl.
*G03G 15/00* (2006.01)

(52) U.S. Cl. ..... 399/82; 399/302; 399/309

(58) Field of Classification Search ..... 399/309, 399/302, 82

See application file for complete search history.

(56) References Cited

U.S. PATENT DOCUMENTS

| | | | | |
|---|---|---|---|---|
| 5,835,831 | A * | 11/1998 | Staudenmayer et al. | 399/308 |
| 6,204,927 | B1 | 3/2001 | Saito et al. | 358/1.12 |
| 6,222,606 | B1 * | 4/2001 | Fuchiwaki et al. | 399/308 X |
| 6,263,174 | B1 * | 7/2001 | Fuchiwaki et al. | 399/82 |
| 6,701,110 | B1 | 3/2004 | Ono | 399/226 |

FOREIGN PATENT DOCUMENTS

JP 2001-154440 A * 6/2001

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes a photosensitive member, an intermediate transfer material, a first transfer device, a second transfer device, a feed device, a refeed device, and a controller which executes selectively first and second modes, in which one or two images are formed on one round of the intermediate transfer material. An image, which should be formed on a refed sheet, is formed on a first half area on one round of the intermediate transfer material, and an image, which should be formed on a fed sheet, is formed on a second half area on one round, in a case of executing the second mode when performing image formation on both sides of a sheet. The first mode is executed before returning to the second mode after executing the first mode instead of executing the second mode when performing both side image formation.

9 Claims, 7 Drawing Sheets

IMAGE FORMING APPARATUS OPERABLE IN PLURAL MODES OF FORMING IMAGES ON INTERMEDIATE TRANSFER MEMBER

BACKGROUND OF THE INVENTION

1. Field of the Invention

The present invention relates to an image forming apparatus that can form two images on one round of an intermediate transfer material.

2. Related Background Art

Early copying machines and color printers which output color documents in offices were not commonly used because of expensive main parts cost and running cost in comparison with monochrome machines, although there were potential demands. This is because most business documents were monochrome outputs and there were few color copying machines and color printers with low main parts costs and low running costs to meet the demand. However, color copying machines and color printers achieving main part costs and running costs almost equivalent to monochrome machines as office applications and enabling color outputs easily in offices have been developed in recent years. Hence, switching to the color machines instead of conventional monochrome machines has been progressing in offices.

In order to replace a monochrome machine with a color machine in this manner, a space of its main part also becomes important as well as the realization of functions being the same as those of a monochrome machine. For this reason, in comparison with a tandem type color image forming apparatus formed by horizontally arranging four photoconductive (or photosensitive) drums which form four colors of images for color image formation concurrently, a one-drum type image forming apparatus, which uses one photoconductive drum and transfers an image, formed on the photoconductive drum, on an intermediate transfer material, and forms four colors of images by four revolutions of a developer by switching the developer to another every round of the intermediate transfer material, can not only decrease the size of the apparatus itself, but also can keep the main part cost low. In addition, in the case of printing both sides, although it is necessary to reverse a sheet, on the one side of which an image is formed, and to convey the sheet to a position where the double-sided sheet is resupplied, it is possible to suppress the size of the apparatus by making a reversing port for reversing this sheet serve also as a sheet discharging port.

However, in such a one-drum type color image forming apparatus, since it is necessary to perform color image formation by the four rounds of the intermediate transfer material, the productivity of a color output is low in comparison with that of a tandem system.

Therefore, as shown in U.S. Pat. No. 6,204,927, for example, in regard to an image in A4 size or letter (LTR) size which is sheet size generally used in an office, the decrease of productivity is suppressed as much as possible by outputting two images at a time by performing two sheets of image formation on an intermediate transfer material while the intermediate transfer material, having the peripheral length enabling image formation in A3 size, takes one round (thereinafter, this is called "two-sheet affixing" or "two-affix").

As described above, in color image formation, the two-sheet affixing is performed in principle to form two sheets of images so that they may exist concurrently.

However, in the two-sheet affixing, since two images on the intermediate transfer material are close, a sheet interval between two sheets on which these images should be transferred must be conveyed with approaching with each other. On the other hand, in the case of the double-sided image formation accompanied by reversal in a sheet discharging port, a sheet interval between the sheet, being reversed, and a sheet following the sheet being reversed should be such that the subsequent sheet may be conveyed to the sheet discharging port after the reversal operation of the sheet being reversed is completed. Therefore, if control is such that the two-sheet affixing is performed in the order of sheets being ready for image formation, there arises a problem that the reversal of the sheet in the sheet discharging port cannot be performed.

Nevertheless, if image formation is performed in a one-sheet affixing mode in all pages, there is a problem that productivity falls remarkably.

SUMMARY OF THE INVENTION

In view of the above problems, the present invention is devised, and aims at providing an image forming apparatus which can return the control to form two images on one round of an intermediate transfer material without causing interference between sheets, even if there arises the case that two images cannot be formed on one round of the intermediate transfer material by various factors at the time of image formation.

Another object of the present invention is to provide an image forming apparatus characterized in comprising a photosensitive member, an intermediate transfer material, a first transfer device which transfers an image, formed on the above-mentioned photosensitive member, on the intermediate transfer material, a second transfer device which transfers on a sheet the above-mentioned image formed on the intermediate transfer material, a feed device which feeds the sheet to the above-mentioned second transfer device, a refeed device which refeeds the sheet, on which the image is transferred by the above-mentioned second transfer device, to the above-mentioned second transfer device with reversing the sheet, and a controller which executes selectively a first mode, in which one image is formed on one round of the above-mentioned mid-transfer material, and a second mode in which two images are formed on one round of the above-mentioned mid-transfer material, that the above-mentioned controller makes an image, which should be formed on a sheet refed by the above-mentioned refeed device, formed on a first half area on one round of the above-mentioned mid-transfer material, and makes an image, which should be formed on a sheet fed by the above-mentioned feed device, on a second half area on one round of the above-mentioned mid-transfer material when executing the above-mentioned second mode when performing image formation on both sides of a sheet, and that the above-mentioned controller executes the above-mentioned first mode before returning to the above-mentioned second mode after executing the above-mentioned first mode instead of executing the above-mentioned second mode when performing image formation on both sides of a sheet.

DESCRIPTION OF THE PREFERRED EMBODIMENTS

Hereafter, an image forming apparatus according to the present invention will be explained in detail with reference to drawings.

(Embodiments)

Figure 1:
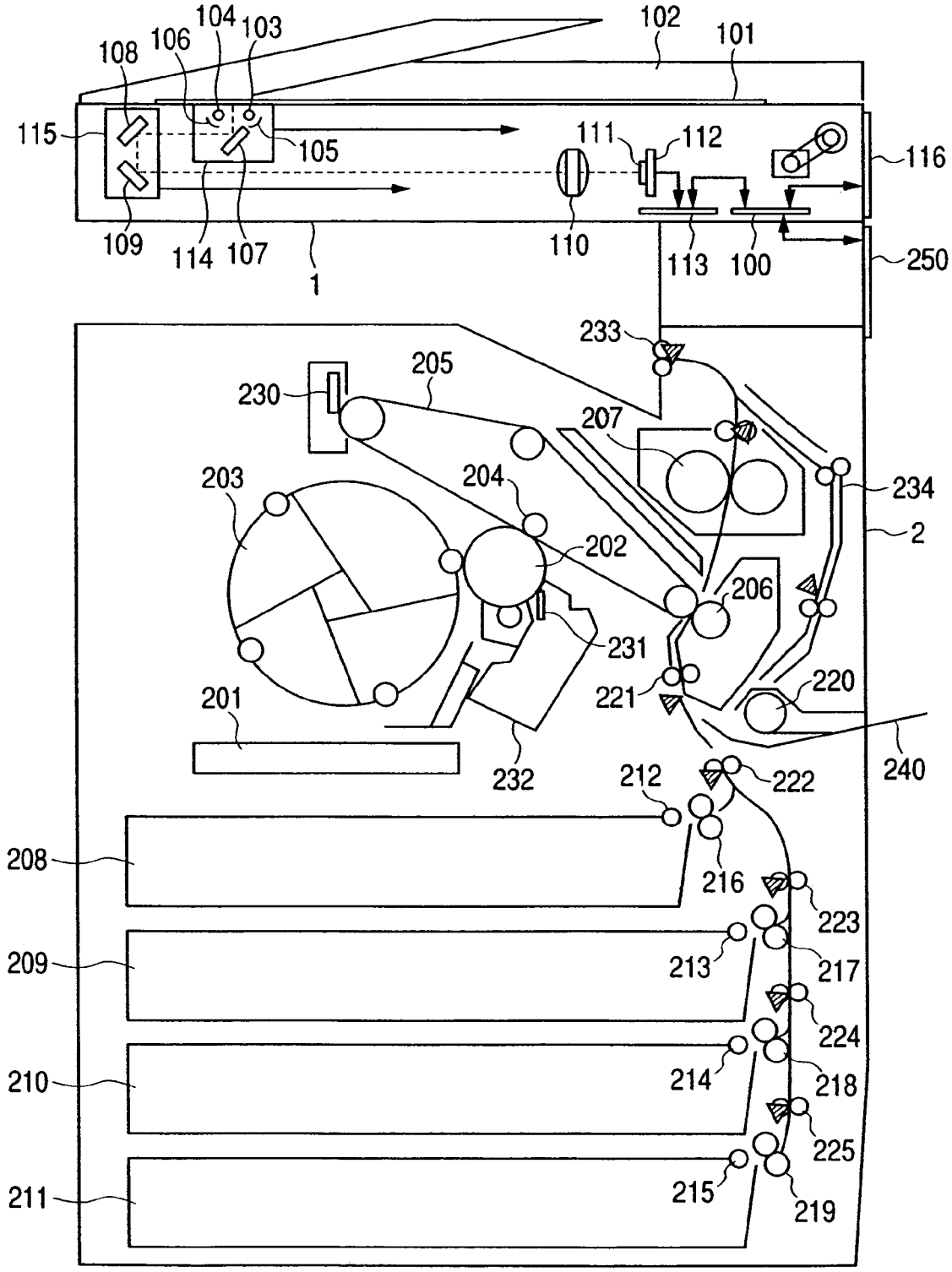
FIG. 1 is a schematic structural diagram showing an image forming apparatus according to an embodiment of the present invention.

FIG. 1 is a schematic sectional diagram of a full-color image forming apparatus (compound machine having a copy function, a printer function and a FAX function) of this embodiment.

Reference numeral 1 denotes a digital color image reader, and 2 denotes a digital color image printer.

The full-color image forming apparatus of this embodiment has the digital color image reader 1 in an upper portion, and has the digital color image printer 2 in a lower portion.

First, the structure of the digital color image reader 1 will be explained.

Reference numeral 100 denotes a control unit controlling the entire image forming apparatus, 101 denotes original sheet table glass (platen), and 102 denotes an automatic document feeder (ADF) which feeds an original sheet to the original sheet table glass automatically.

In addition, a specular surface pressure plate or a white pressure plate (not shown) can be also mounted instead of this automatic document feeder 102.

Light sources 103 and 104 which illuminate an original sheet include light sources such as halogen lamps, fluorescent lamps, and xenon tube lamps.

Reflectors 105 and 106 condense the light of the light sources 103 and 104 on an original sheet.

Reference numerals 107 to 109 denote mirrors, 110 denotes a lens, and 111 denotes a CCD image sensor (a charge coupled device image sensor, and hereafter, this is referred to as a "CCD"). The lens 110 condenses the light reflected from an original sheet or projection light on the CCD 111.

Reference numeral 112 denotes a board on which the CCD 111 is mounted, and 113 denotes a digital image processing unit.

Reference numeral 114 denotes a carriage which contains the light sources 103 and 104, reflectors 105 and 106, and mirror 107.

Reference numeral 115 denotes a carriage which contains the mirrors 108 and 109.

In addition, the carriage 114 and carriage 115 scan the entire surface of an original sheet by mechanically moving at velocity V and velocity V/2, respectively, in a sub-scanning direction which is orthogonal to an electric scanning direction (main scanning direction) of the CCD 111.

Reference numeral 116 denotes an external I/F with other devices, and specifically, the external I/F 116 can be connected to a facsimile machine (not shown), a LAN I/F device (not shown), etc. In addition, the control of communication procedures of image information and code information with a facsimile machine or a LAN I/F device is performed by the two way communication between a control unit (not shown) of each connected apparatus and a CPU 301.

The digital color image printer 2 will be explained later.

Next, the structure of a control unit 100 will be explained by using FIG. 2.

Figure 2:
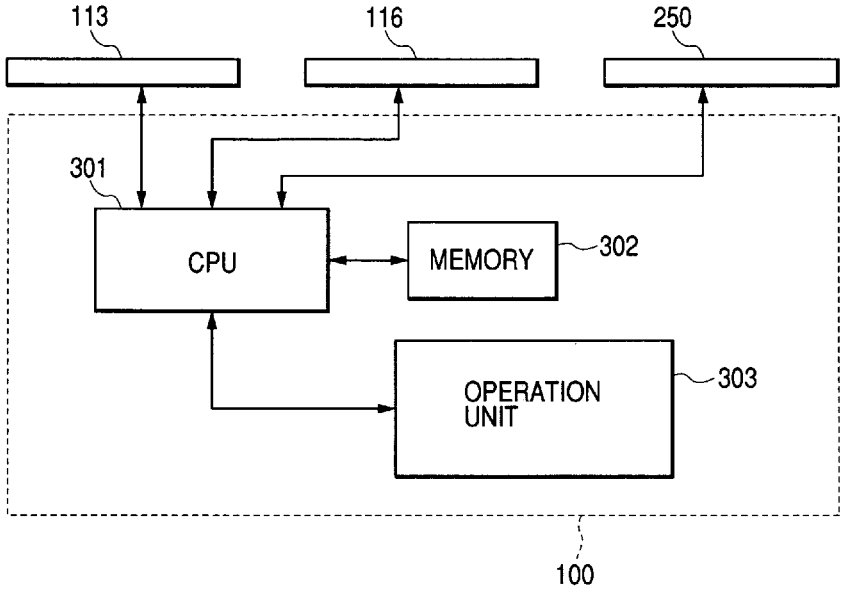
FIG. 2 is a schematic diagram showing the control structure of an image forming apparatus according to an embodiment of the present invention.

FIG. 2 is a schematic diagram showing the structure of the control unit 100 of the image forming apparatus according to the present invention.

Reference numeral 250 denotes a printer control unit, 301 denotes the CPU which is control means, 302 denotes a memory, and 303 denotes an operation unit.

The operation unit 303 is constituted by a liquid crystal with a touch panel for inputting the contents of process execution by an operator, and reporting information and a warning about processing to the operator.

The control unit 100, as shown in FIG. 2, comprises the CPU 301 with an interface (hereafter, "I/F") which exchanges information for performing control to a digital image processing unit 113 and a printer control unit 250, respectively, the operation unit 303 and memory 302.

Next, the digital image processing unit 113 and control unit 100 will be explained in detail.

Figure 3:
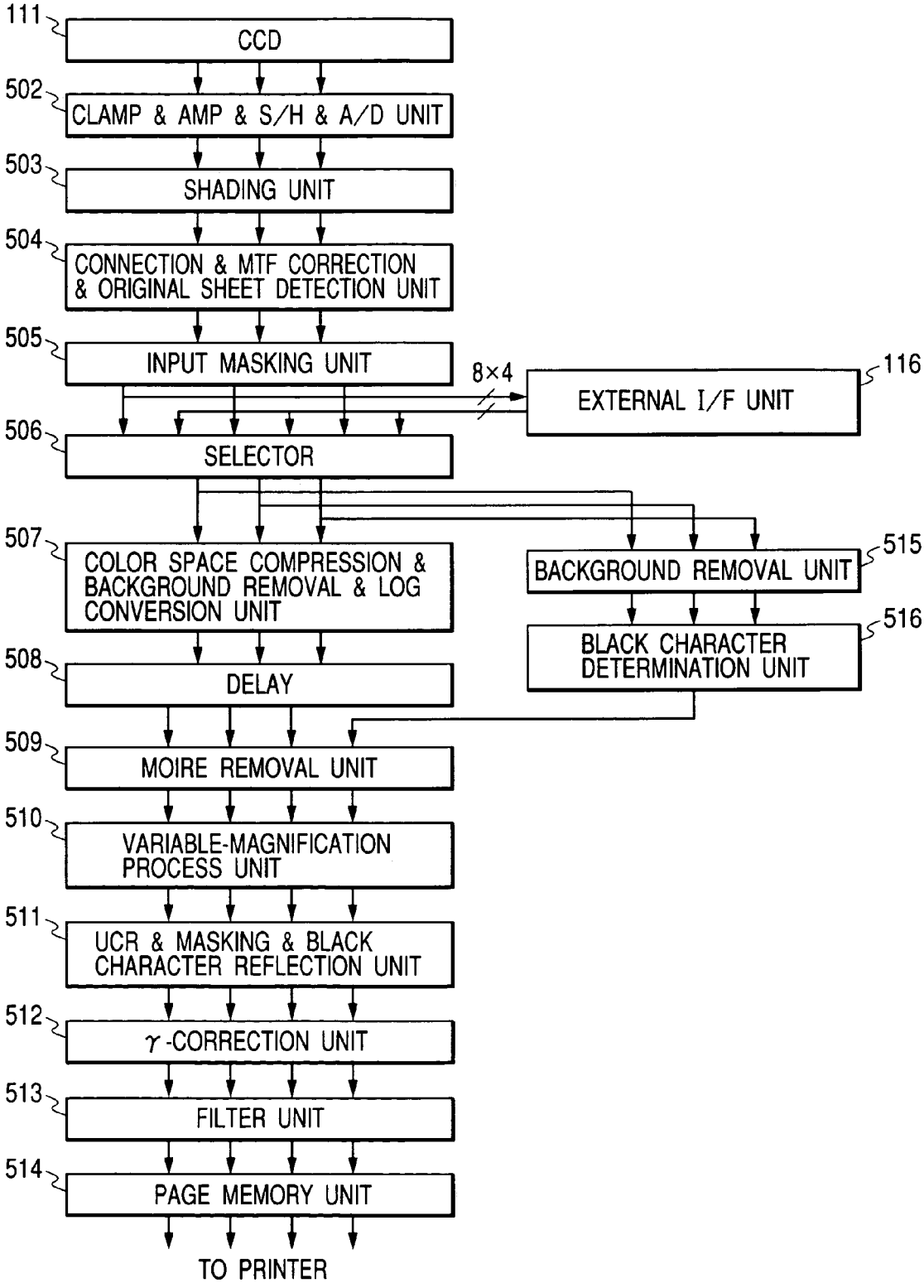
FIG. 3 is a block diagram showing the flow of an image signal in an image processing unit according to an embodiment of the present invention.

FIG. 3 is a block diagram showing the detailed structure that the digital image processing unit 113 and control unit 100 output image signal data to the printer control unit 250.

Reference numeral 502 denotes a clamp & Amp & S/H & A/D unit and 503 denotes a shading unit, 504 denotes a connection & MTF correction & original sheet detection unit, and 505 denotes an input masking unit. Reference numeral 506 denotes a selector, and 507 denotes a color space compression & background removal & log conversion unit. Reference numeral 508 denotes a delay unit, 509 denotes a moire removal unit, 510 denotes a variable-magnification process unit, 511 denotes a UCR & masking & black character reflection unit, 512 denotes a γ-correction unit, 513 denotes a filter unit, 514 denotes a page memory unit, 515 denotes a background removal unit, and 516 denotes a black character determination unit.

An original sheet on the original table glass reflects light from the light sources 103 and 104, and the reflected light is led to the CCD 111 to be converted into an electrical signal (when the CCD 111 is a color sensor, it is sufficient that R, G and B color filters are put in line on the one-line CCD in the order of R, G and B, that an R filter, a G filter, and a B filter are arranged respectively on the three-line CCD, or that a filter is an on-chip filter or a filter is separated from the CCD).

Then, the electrical signal (analog image signal) is inputted into the digital image processing unit 113, and is given a sample-and-hold operation (S/H) in the clamp & Amp & S/H & A/D unit 502 to clamp a dark level of the analog image signal to a reference potential, amplified up to a predetermined amount (the above-mentioned processing order is not always the order of the notation), and A/D converted into, for example, R, G and B 8-bit digital signals.

Then, the R, G and B signals are given shading correction and black correction in the shading unit 503. Thereafter, the connection & MTF correction & original sheet detection unit 504 corrects in the connection processing signal timing so that reading positions of three lines may become the same by adjusting a delay amount every line according to each reading rate since the reading positions between lines are different from one another when the CCD 111 is a three-line CCD; corrects in the MTF correction changes in reading MTF since the reading MTF changes by the reading rate or variable-magnification rate; and recognizes in the original sheet detection an original sheet size by scanning the original sheet on the original table glass in original sheet detection.

The digital signals corrected in the reading position timing are corrected in the spectral characteristic of CCD 111 and the spectral characteristic of the light sources 103 and 104, and reflectors 105 and 106 by the input masking unit 505.

An output of the input masking unit 505 is inputted into the selector 506, and it is switchable with an external I/F signal.

The signal outputted from the selector 506 is inputted into the color space compression & background removal & log conversion unit 507 and background removal unit 515.

After the signal inputted into the background removal unit 515 is given the background removal, it is inputted into the black character determination unit 516 which determines whether it is a black character of the original sheet on the original sheet, and a black character signal is generated from the original sheet.

In addition, the color space compression & background removal & log conversion unit 507 into which another output of the selector 506 is inputted determines in the color space compression whether the read image signal is within the range which is reproducible by the printer. If it is within the range, the image signal is kept as it is, but if not, the image signal is corrected so that it may go into the range where the printer can reproduce the image signal.

Then, the unit 507 performs background removal processing and converts R, G and B signals into Y, M and C signals in a log conversion unit.

Thereafter, in order to correct timing with the signal generated by the black character determination unit 516, the output signal of the color space compression & background removal & log conversion unit 507 is adjusted for its timing in the delay unit 508.

Moire in two kinds of signals from the black character determination unit 516 and delay unit 508 is removed by the moire removal unit 509, and the two kinds of signals are given variable-magnification processing in the main scanning direction by the variable-magnification process unit 510.

Then, in the UCR & masking & black character reflection unit 511, the signal processed by the variable-magnification process unit 510 is processed in the UCR processing so that Y, M, C and K signals may be generated from the Y, M and C signals. In the masking processing unit, the signals are corrected so as to be suitable for the outputting of the printer. Further, in the black character reflection unit, the determination signal generated by the black character determination unit 516 is fed back to the Y, M, C and K signals.

The signal processed by the UCR & masking & black character reflection unit 511 is given smoothing and edge processing by the filter unit 513 after being given density adjustment by the γ-correction unit 512.

The image data information processed as described above is once stored in the page memory 514 in the control unit 100 and is transmitted to the printer control unit 250 as each image data signal while being synchronized with each video clock by turns according to image writing reference timing of each color from the printer control unit 250.

Next, returning to FIG. 1, the structure of the digital color image printer 2 will be explained.

FIG. 1 shows a laser scanner 201 which is latent image forming means, a photosensitive drum 202 which is a photosensitive member, a multi-color developer 203 which consists of developing means and development switching means, and a primary transfer roller 204 which is first transfer means.

The laser scanner 201, photosensitive drum 202 and multi-color developer 203 constitute image forming means.

Reference numeral 205 denotes an intermediate transfer material (or mid-transfer material), 206 denotes a secondary transfer roller which is second transfer means, 207 denotes a pressure roller, 208, 209, 210 and 211 denote cassettes, 212, 213, 214 and 215 denote sheet supply rollers, and 216, 217, 218 and 219 denote sheet separation rollers. Furthermore, reference numeral 220 denotes a manual sheet supply roller, 221 denotes a registration roller, 222, 223, 224 and 225 denote vertical path convey rollers, 230 denotes a cleaning blade, 231 denotes a blade, 232 denotes a waste toner box, 233 denotes a sheet discharging roller which is a sheet discharging port also serving as a reversing port, 234 denotes a double-side path, and 240 denotes a manual supply tray.

In FIG. 1, the printer control unit 250 receives the control signal from the CPU 301 in the control unit 100 which is a control unit of the entire image forming apparatus.

According to the control signal such as a print start from the control unit 100, the printer control unit 250 performs the print control of the digital color image printer 2.

The laser scanner 201 scans a laser beam, corresponding to the image data signal, in the main scanning direction by a polygon mirror, and radiates the beam to the photosensitive drum 202.

An electrostatic latent image formed on the photosensitive drum 202 arrives in a sleeve position of one color in respective colors of a four-color developing rotary by the clockwise revolution of the photosensitive drum 202.

Toner according to an amount of electric potential formed between a surface of the photosensitive drum 202, having the electrostatic latent image, and a developing sleeve surface where a developing bias is applied is flown from the multi-color developer 203 to the surface of the photosensitive drum 202. Hence, the electrostatic latent image on the surface of the photosensitive drum 202 is developed.

A toner image formed on the photosensitive drum 202 is transferred by the clockwise revolution of the photosensitive drum 202 to the intermediate transfer material 205 which rotates counterclockwise (primary transfer).

In the case of a black monochrome image, image formation is performed to the intermediate transfer material 205 by turns with providing a predetermined time interval (primary transfer).

In the case of a full color image, the sleeve alignment of the developing rotary is performed sequentially every color. Then, the electrostatic latent image corresponding to each color on the photosensitive drum 202 is given the development and primary transfer. After four revolutions of the intermediate transfer material 205, that is, when the primary transfer of four colors (yellow (Y), magenta (M), cyan (C) and black (K)) is completed, the primary transfer of the full color image is completed.

On the other hand, a sheet is supplied by each of sheet feed rollers 212, 213, 214 and 215 for respective cassette stages from each of cassettes (an upper stage cassette 208, a lower stage cassette 209, a third stage cassette 210 and a fourth stage cassette 211). The sheet conveyed by each of the sheet separation rollers 216, 217, 218 and 219 for respective cassette stages is conveyed to the registration roller 221 by the vertical path convey rollers 222, 223, 224 and 225.

In the case of manual supply, a sheet loaded or stacked on a manual supply tray 240 is conveyed to the registration roller 221 by the manual supply roller 220.

Then, the sheet is conveyed between the intermediate transfer material 205 and secondary transfer roller 206 in the timing when the transfer to the intermediate transfer material 205 is completed.

Thereafter, the sheet is stuck to the intermediate transfer material 205 by pressure while it is conveyed toward the fixing device with being inserted between the secondary transfer roller 206 and mid-transfer material 205. Further, the secondary transfer of four colors of toner images on the intermediate transfer material 205 is performed to the sheet.

The toner images transferred to the sheet are heated and pressurized by a fixing roller and the pressure roller 207, and are fixed to the sheet.

In addition, in regard to transfer-residual toner on the intermediate transfer material 205 which remains without being transferred on the sheet, the cleaning blade 230 which can contact and be released contacts to the surface of the intermediate transfer material 205 and scrapes the transfer-residual toner from the surface of the intermediate transfer material 205, which is cleaned by the post-process control in the last half of the image forming sequence.

In the photosensitive drum unit, the residual toner is scraped from the surface of the photosensitive drum 202 by the blade 231, and is conveyed to the waste toner box 232 which is integrated in the photosensitive drum unit.

Furthermore, in regard to residual toner with positive and negative polarities on the surface of the secondary transfer roller 206 where the residual toner may be adsorbed, the residual toner with respective polarities is made adsorbed on the intermediate transfer material 205 by applying a secondary transfer normal bias and a secondary transfer reverse bias by turns. Next, by scraping the residual toner by the above-described cleaning blade 230, the residual toner is cleaned completely, and then, post-processing control is finished.

The sheet on which the image is fixed is ejected via the sheet discharging roller 233.

In double-sided image formation, in order that the sheet on which the image being fixed is laid is given reversal processing outside the apparatus through the sheet discharging roller 233, an edge of the sheet is once ejected to the discharging port, and the sheet stops with leaving the rear edge by a predetermined distance inside the apparatus.

That is, a reversal start command is waited in the state of leaving the rear edge of the sheet in a position apart by the predetermined distance from the sheet discharging roller 233, which is a reversal standby position, so as to reverse and lead the sheet to the double-side path 234.

When the reversal start command is issued, the sheet currently waiting in the reversal standby position is reversed by the sheet discharging roller 233, and is conveyed from the reversal standby position to the double-side standby position through the double-side path 234.

After the sheet conveyed through the double-side path 234 is detected by a double-side sensor, the sheet advances by the predetermined distance, and thereafter, once waits in the double-side standby position.

Then, when a second-side image of both-sided ones becomes ready and a sheet resupply command is issued, the sheet currently waiting in the sheet resupply position is conveyed to the registration roller 221 for secondary image formation. Then, the second-side image of both-side ones is formed.

At the time of full color image formation, images for two sheets are formed on one round (or full circumference) of the intermediate transfer material 205 (two-sheet affixing) as it can do according to the fact that sheet size is small such as A4 or letter size (LTR). It is also possible to perform such control that images for three or more sheets can be formed on the intermediate transfer material 205 according to the peripheral length of the intermediate transfer material 205 and sheet length.

In this embodiment, control is performed so that the length in the subscanning direction may be made suitable for arranging and forming images for two sheets on one round of the intermediate transfer material 205 in the case of sheets below LTR size (=216 mm).

Then, at the time of single-sided image formation, the images which are arranged on one round of the intermediate transfer material 205 and formed for two sheets are transferred one at a time for two sheets supplied from the same one of the cassettes 208, 209, 210 and 211.

In addition, at the time of double-sided image formation, the images are transferred one at a time for the sheet, which is waiting in the double-side standby position on the double-side path 234 and on whose one side the image has been already formed, and a sheet which is supplied from a cassette. That is, at the time of double-sided image formation, images which are arranged and formed on one round of the intermediate transfer material 205 is two of an image which should be formed on the sheet currently waiting in the double-side standby position on the double-side path 234, and an image which should be formed on a sheet supplied from a cassette.

In this case, in regard to the double-sided image formation, another side image (image to the sheet from a sheet resupply unit) of double-sided image data one of which has been already formed on one side, and another side image (image to the supplied sheet) of the double-sided image data which has not been given image formation yet are formed alternately.

In addition, in regard to an image to a sheet having the size larger than LTR size such as B4, A3 or A4R, since it is not possible to arrange and form images for two sheets on one round of the intermediate transfer material 205, only the image for one sheet is formed on one round of the intermediate transfer material 205.

Next, the image formation order at the time of double-sided image formation will be explained by using FIG. 4.

Figure 4:
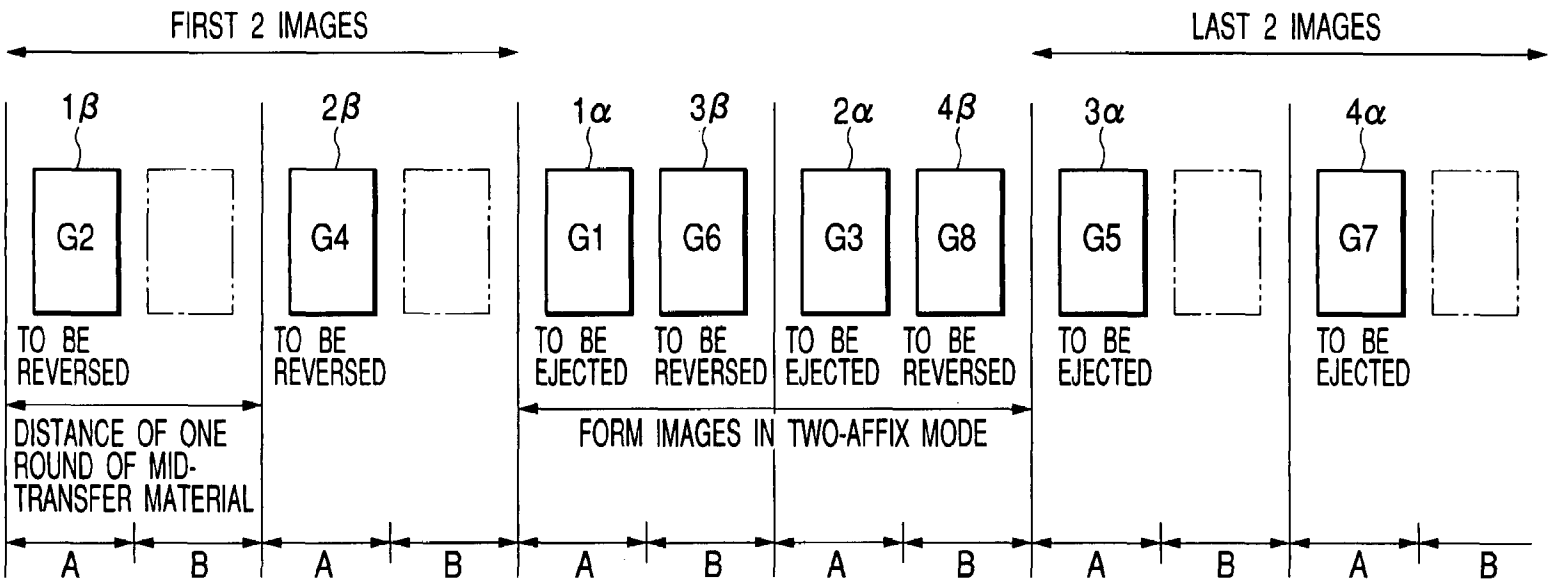
FIG. 4 is an explanatory diagram explaining double-sided image formation order according to an embodiment of the present invention.

FIG. 4 is a diagram of explaining the order of images which should be formed on the intermediate transfer material (or mid-transfer material) 205 for explaining the image formation order at the time of double-sided image formation. The length or distance for one round of the intermediate transfer material 205 is as shown in the figure, and two or more rounds of the intermediate transfer material 205 are shown in the figure. In addition, let a first half of one round of the intermediate transfer material 205 be an area A, and let a last half be an area B, in the following description.

Here, 1α denotes a front side of a first sheet, 1β denotes a back side of the first sheet, 2α denotes a front side of a second sheet, 2β denotes a back side of the second sheet, 3α denotes a front side of a third sheet, 3β denotes a back side of the third sheet, 4α denotes a front side of a fourth sheet, and 4β denotes a back side of the fourth sheet. In addition, G1, G2, G3, G4, G5, G6, G7 and G8 denote images, G1, G3, G5 and G7 denote the images on a front side of each sheet, and G2, G4, G6 and G8 are the images on a back side of each sheet. Moreover, the number applied to G of G1 to G8 expresses the page number of an image.

FIG. 4 shows an example in the case of forming images for eight sheets on both sides of four sheets.

In the full color image formation on both sides in this embodiment, it is possible to make two sheets, on whose one side images have been already formed respectively, wait in two standby positions (the double-side standby position and reversal standby position). Hence, double-sided image formation is performed with circulating images for three sheets in combination with a sheet in a sheet supplying position.

Image formation order at that time, as shown in FIG. 4, is first to form images for first and last two sheets (corresponding to the images G2 and G4 and images G5 and G7, respectively) of double-sided image formation in the area A on the intermediate transfer material 205 in a one-sheet affixing mode. Then, third and later images are formed in a two-sheet affixing (or two-affix) mode where an image (odd-numbered image) to a sheet currently waiting in the sheet resupply position in principle is formed in the area A on the intermediate transfer material 205, and an image (even-numbered image) to a sheet waiting in the sheet supply position (or the predetermined position after sheet supply) is formed in the area B on the intermediate transfer material 205.

Owing to this, it is possible to perform the reversal operation in the sheet discharging unit with preventing the decrease of productivity. That is, the two-sheet affixing prevents the decrease of productivity. However, when the two-sheet affixing of G2 and G4 is performed, a sheet 2β where G4 is formed rushes in to a place where a sheet 1β where G2 is formed is being reversed in the sheet discharging unit. Hence, it becomes not possible for the sheet 1β to be reversed. Then, it becomes possible to avoid this problem by making G2 and G4 in the one-sheet affixing (or one-affix) mode and making images after G1 in the two-sheet affixing mode.

In addition, when the sheet 1β on which G2 is formed is reversed and sheet resupply becomes ready, an image which should be formed on the sheet 1α (back side of the sheet 1β) is formed. Here, the image G1 which should be formed on the sheet 1α is formed in the two-sheet affixing mode with the image G6 which should be formed on the sheet 3β supplied from a cassette. However, in this two-sheet affixing, these images are not arranged in order of G6 and G1, but as shown in FIG. 4, are arranged in order of G1 and G6. That is, G1 is formed in the area A and G6 is formed in the area B. This reason is as follows. The sheet 1α on which G1 is formed is a sheet to be ejected, and the sheet 3β on which G6 is formed is a sheet to be reversed and resupplied. Hence, when the sheet 1α on which G1 is formed follows the sheet 3β on which G6 is formed, the sheet 1α rushes in when the sheet 3β is reversed, and hence, the sheet 3β cannot be reversed. However, when the sheet 3β on which G6 is formed follows the sheet 1α on which G1 is formed, the sheet 3β is reversed after the sheet 1α is ejected. Furthermore, the formation of an image to be formed on the sheet 2α following the sheet 3β takes the time for four colors (corresponding to four revolutions of the intermediate transfer material 205). Hence, the sheet 2α never rushes in when the sheet 3β is reversed, and therefore, the sheet 3β can be reversed.

Figure 7:
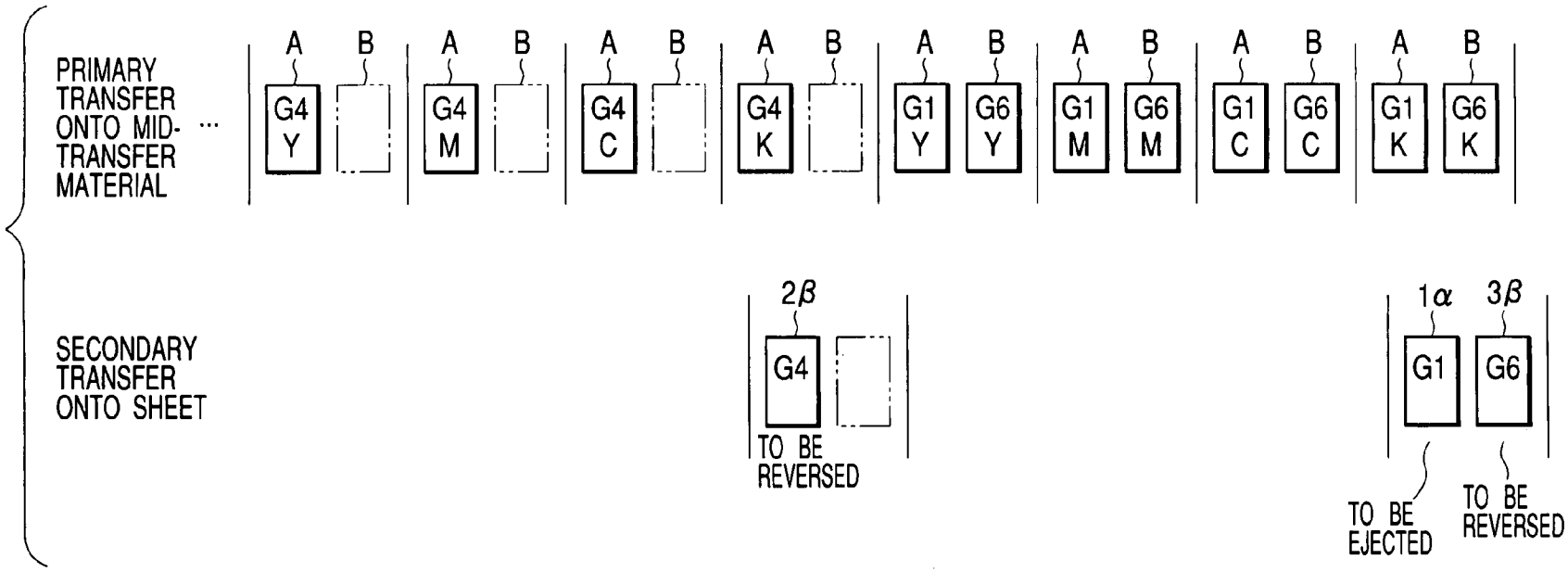
FIG. 7 is an explanatory diagram explaining the timing of primary transfer and secondary transfer according to an embodiment of the present invention.

In addition, although FIG. 4 shows the control of one-sheet affixing and two-sheet affixing, and the control of the order of images at the time of the two-sheet affixing, gaps between sheets in the horizontal axis of FIG. 4 are different from the actual ones. Hence, actual gaps between sheets will be explained by using FIG. 7. FIG. 7 shows a state of the primary transfer to the intermediate transfer material 205, and a state of the secondary transfer from the intermediate transfer material 250 to a sheet in regard to the images G4, G1 and G6 in FIG. 4, and this is similar for other images. As for the image G4, the image is formed in the area A of the intermediate transfer material 205 in the one-sheet affixing mode, and primary transfer of four colors is performed in the order of Y, M, C and K to the intermediate transfer material 205 by four revolutions of mid-transfer materials 205. Even when the primary transfer of the last color K is performed, the intermediate transfer material 205 continues rotating counterclockwise as it is, and the secondary transfer of the four colors of images on the intermediate transfer material 205 is performed in a position of the secondary transfer roller 206 to the sheet 2β supplied from a cassette. On the other hand, in the intermediate transfer material 205, the images G1 and G6 are formed in the two-sheet affixing mode (G1 is formed in the area A and G6 is formed in the area B) just after the primary transfer of K of G4. Then, the primary transfer of four colors is performed in the order of Y, M, C and K to the intermediate transfer material 205 by four revolutions of the intermediate transfer materials 205. When the primary transfer of the last color K is performed for G1 and G6, the secondary transfer of the image G1 on the intermediate transfer material 205 is performed to the sheet 1α resupplied. Then, the secondary transfer of the image G6 is performed to the sheet 3β which is supplied from a cassette with following the sheet 1α. As seen from FIG. 7, the gap between the sheet 2β and sheet 1α is large, but the gap between the sheet 1α and sheet 3β is narrow.

Next, the image formation switching processing of the one-sheet affixing and two-sheet affixing at the time of the double-sided image formation which is this embodiment will be explained by using FIGS. 5 and 6.

Figure 5:
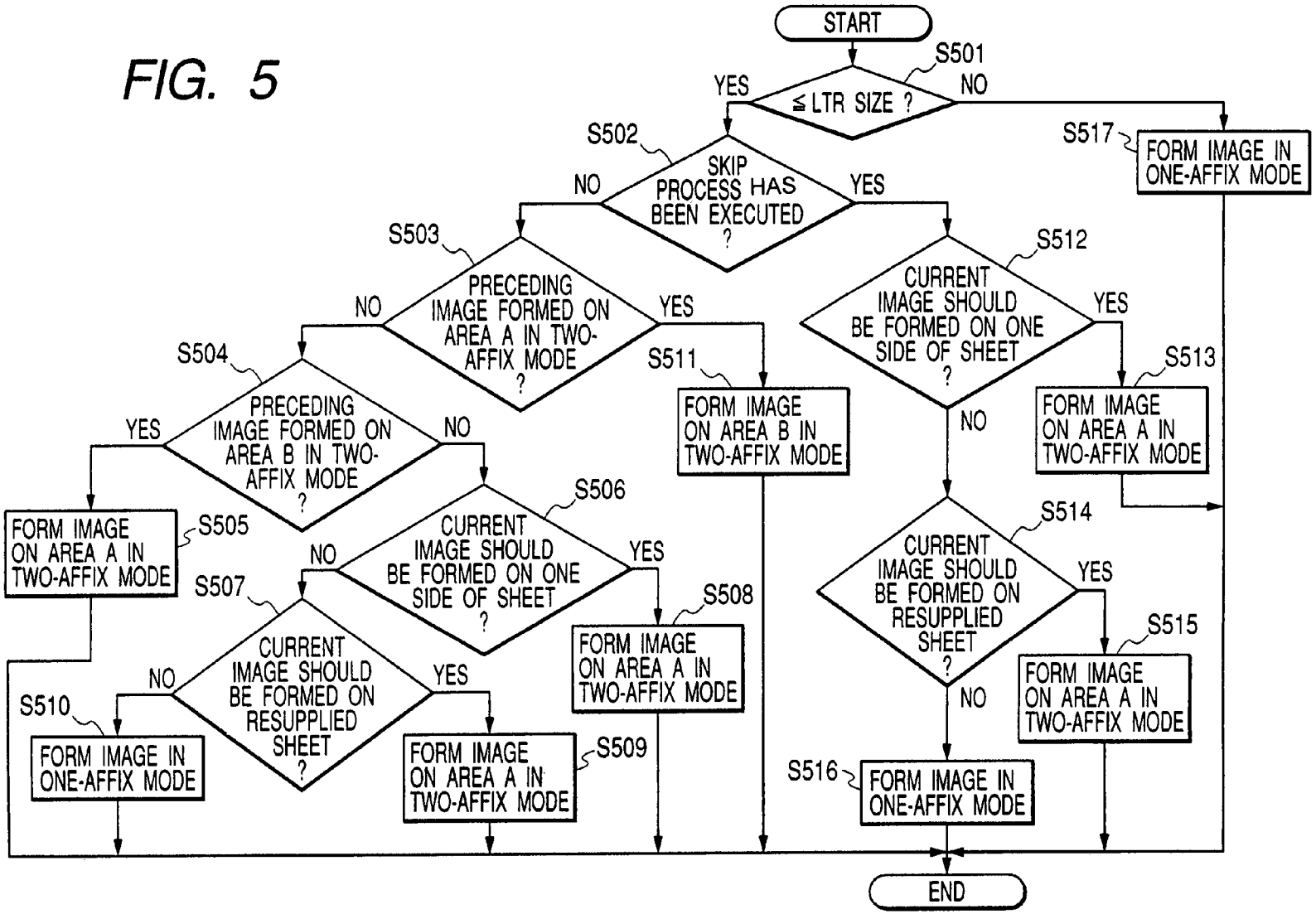
FIG. 5 is a flow chart explaining image formation control according to an embodiment of the present invention.
Figure 6:
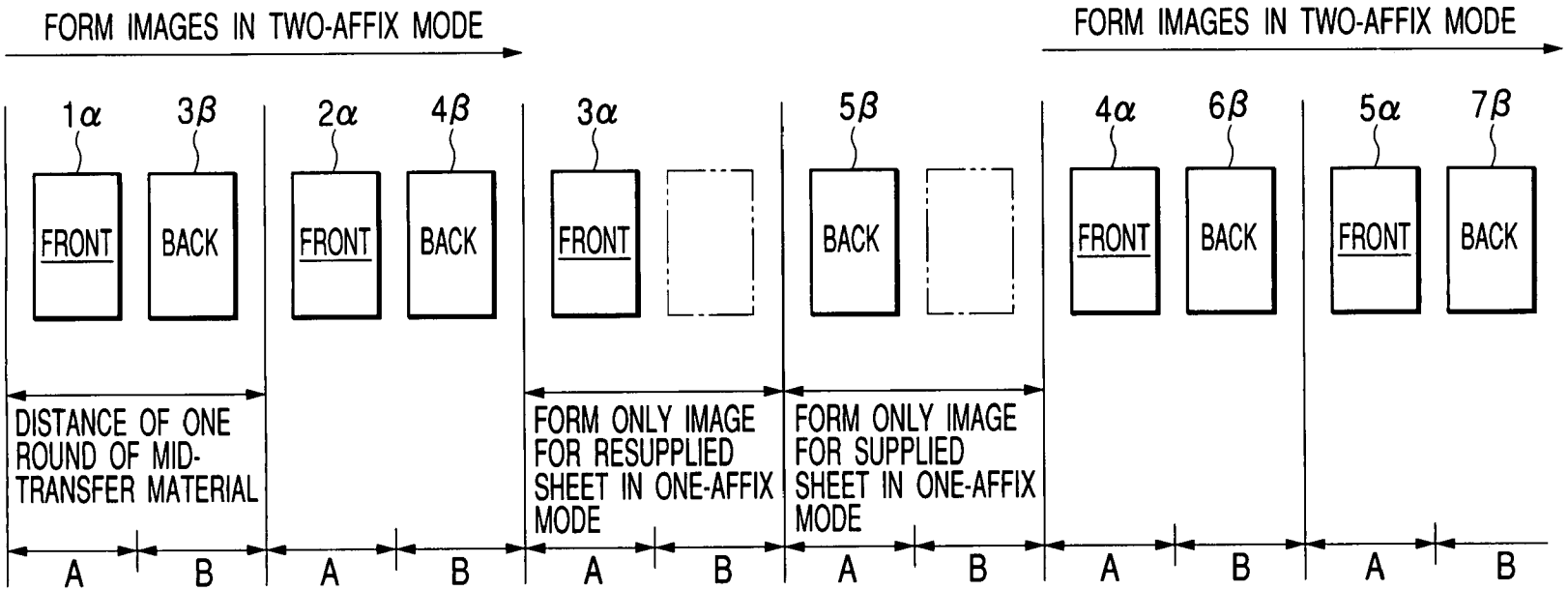
FIG. 6 is an explanatory diagram explaining double-sided image formation control according to an embodiment of the present invention.

FIG. 5 is a flow chart explaining image formation control according to this embodiment, and FIG. 6 is an explanatory diagram explaining double-sided image formation control according to this embodiment.

Here, α of 1α to 7α denotes a front side of a sheet, β of 1β to 7β denotes a back side of a sheet, a number denotes the order of a sheet, and 1β, 2β, 6α and 7α are omitted in FIG. 6.

As mentioned above, in principle, an image to a sheet, which is reversed and resupplied, and an image to a sheet which is supplied from a cassette are arranged and formed on one round of the intermediate transfer material 205 when performing full color image formation also at the time of double-sided image formation. However, under the predetermined conditions described below, there arises the case that this pattern collapses and images for two sheets cannot be arranged and formed on one round of the intermediate transfer material 205.

For example, the case that, although image data which should be formed on a sheet which is reversed and resupplied is prepared, image data which should be formed on one round of the intermediate transfer material 205 in parallel to this image and should be formed on a sheet supplied from a cassette is not ready (the case that the development to image data from page description language takes time, and the case that data transfer takes time because of the congestion of traffic on a LAN connected to the external I/F 116), the case that, for image stabilization, for example, the process for measuring image density (image density measurement processing), cleaning treatment, toner residual-quantity detection processing, etc. (image formation processing for the image stabilization) are required, the case that, in the structure of having a rotary developer like this embodiment, time becomes necessary for rotating a mirror image machine because of the color mode switching from full color image formation to monochrome image formation (change in the color mode), and the like falls under the above-described predetermined conditions.

In such cases, since it is necessary to insert a process during image formation in the two-sheet affixing mode, it is not possible to form an image so that two images may coexist concurrently, and hence, image formation is performed one by one (one-sheet affixing).

Then, when the two-sheet affixing becomes possible, recovery to the two-sheet affixing will be again performed.

This detailed control will be explained on the basis of a flowchart in FIG. 5.

In FIG. 5, it is first discriminated at step S501 whether sheet size is suitable for the two-sheet affixing.

When the size is larger than the LTR size, the two-sheet affixing is not possible, and hence, an image is formed in the one-sheet affixing mode (step S517).

When the size is the LTR size or smaller, the two-sheet affixing is possible, and next, it is discriminated whether there was any skip processing in previous image formation (step S502).

Although this skip processing will be described later, it is fundamentally used for recovery processing when a control pattern of the two-sheet affixing collapses, and hence, this skip processing is not usually performed.

When there was the skip processing, the process goes to step S512. When there was no skip processing, the process goes to step S503, and it is discriminated whether the previous image was formed in the area A in the two-sheet affixing mode.

When the previous image was formed in the area A in the two-sheet affixing mode at step S503, the process goes to step S511 and it is controlled so that a current image may be formed in the area B in the two-sheet affixing mode.

When the previous image was not formed in the area A in the two-sheet affixing mode at step S503, the process goes to step S504 and it is discriminated whether the previous image is formed in the area B in the two-sheet affixing mode.

When the previous image was formed in the area B in the two-sheet affixing mode at step S504, it is controlled so that a current image may be formed in the area A in the two-sheet affixing mode (step S505).

When the previous image was not formed in the area B in the two-sheet affixing mode at step S504, the process goes to step S506 and it is discriminated whether the current image is an image which should be given single-sided image formation.

When the current image is the image, which should be given single-sided image formation, at step S506, it is controlled so that the current image may be formed in the area A in the two-sheet affixing mode (step S508).

When the current image is not the image, which should be given single-sided image formation, at step S506, that is, is an image which should be given double-sided image formation, the process goes to step S507, and it is discriminated whether the current image is an image which should be formed on a sheet from a double-side sheet resupply unit.

When the current image is the image, which should be formed on the sheet from the double-side sheet resupply unit, at step S507, it is controlled so that the current image may be formed in the area A in the two-sheet affixing mode (step S509). When the current image is not the image, which should be formed on the sheet from the double-side sheet resupply unit, that is, when being the image which should be formed to an unrecorded sheet from a cassette, it is controlled so that the current image may be formed in the one-sheet affixing mode (step S510). Here, in the one-sheet affixing mode, it is controlled so that an image is formed in the area A of the intermediate transfer material 205 as described above.

That is, the flowchart after step S503 specifically shows the control of forming an image in the two-sheet affixing when the two-sheet affixing is possible, and forming an image in the one-sheet affixing when the two-sheet affixing is impossible.

Then, as shown in 1α, 3β, 2α and 4β of FIG. 6, at the time of normal double-sided image formation, images are formed in the two-sheet affixing mode by pairing two of the image to a front side of a sheet from the sheet resupply unit, and the image to a back side of a sheet from sheet supply.

With seeing each image, this processing performs the processing of step S505 and step S511 in FIG. 5 by turns.

However, there may arise the case that this pattern collapses under various conditions as mentioned above and it becomes impossible to perform formation so that images for two sheets may coexist concurrently.

Hereafter, recovery processing in this case will be explained.

For example, if the formation of a current image is not ready in time of two-sheet affixing formation at step S511 when a preceding image is formed in the area A in the two-sheet affixing mode (step S503), a skip processing flag is set for performing the skip processing (S511).

At this time, although the preceding image is formed in the area A in the two-sheet affixing mode, an image does not exist in the area B in the two-sheet affixing mode, and hence, actually, the image formation is in the one-sheet affixing mode (a portion in which an image to a sheet from the sheet resupply unit is formed in the one-sheet affixing mode in 3α of FIG. 6).

The flowchart shown in FIG. 5 is executed again after image formation of the current image becomes ready. That is, the skip processing flag which was set at step S502 is discriminated. If the skip processing flag is set, it is discriminated at step S512 whether the current image is an image which should be given double-sided image information. If so, the current image may be formed in the area A in the two-sheet affixing mode (Step S513).

This skip processing flag is cleared after being discriminated at step S502. In the example of FIG. 6, the current image is an image which should be given the double-sided image formation, and hence, the process goes to step S514.

At step S514, it is discriminated whether the current image is an image which should be formed on a sheet from the sheet resupply unit.

When the current image is the image, which should be formed on the sheet from the sheet resupply unit, at step S514, the process goes to step S515, and the current image is formed in the area A in the two-sheet affixing mode.

When the current image is the image, which should not be formed on the sheet from the sheet resupply unit, at step S514, the process goes to step S516, and the current image is formed in the one-sheet affixing mode (corresponding to 5β in FIG. 6).

That is, the flowchart after step S512 specifically shows the control of performing recovery under the limit that an image which should be formed on a sheet which will be reversed and resupplied from the sheet discharging port is formed not in the two-sheet affixing mode but in the one-sheet affixing mode.

In the example shown in FIG. 6, since it is determined at step S514 that the image (current image) to a back side 5β of a fifth sheet is not the image to the sheet from the sheet resupply unit, the process goes to step S516.

Then, the recovery of the two-sheet affixing pattern is performed by processing the image in the one-sheet affixing mode at step S516 (5β in FIG. 6).

That is, the image after being given recovery in the one-sheet affixing mode is given the skip processing at step S502, and hence, is returned to the image formation processing to the area A in the two-sheet affixing mode at step S509. Thereafter, an image to a sheet from the double-side sheet resupply unit and an image to a sheet from the sheet supplying side are formed by turns.

As described above, even if there arises the case that images cannot be formed so that two images may coexist concurrently on the intermediate transfer material because various factors act at the time of image formation, it is possible to prevent the decrease of productivity by returning to the two-sheet affixing pattern without causing interference between sheets.

In the double-sided image formation, it is possible to prevent the decrease of double-side productivity by performing image formation by a double-side circulation amount by returning to the two-sheet affixing pattern without causing interference between sheets.

In addition, if the image next to the current image is an image which should be formed on a sheet from the double-side sheet resupply unit, at steps S505, S509 and S515, not only the current image is formed in the area A in the two-sheet affixing mode, but also the skip flag is set. Owing to this, the last two images in the double-sided image formation are formed substantially in the one-sheet affixing mode, respectively.

As explained above, according to this embodiment, in a one-drum type image forming apparatus, it is possible to provide an image forming apparatus which can prevent the decrease of productivity by returning to the two-sheet affixing pattern without causing interference between sheets, even if there arises the case that images cannot be formed so that two images may coexist concurrently on the intermediate transfer material because various factors act at the time of image formation.

What is claimed is:

1. An image forming apparatus comprising:

a photosensitive member;

an intermediate transfer material;

a first transfer device which transfers on the intermediate transfer material an image formed on the photosensitive member;

a second transfer device which transfers on a sheet the image formed on the intermediate transfer material;

a feed device which feeds the sheet to the second transfer device;

a refeed device which refeeds the sheet, on which the image is transferred by the second transfer device, to the second transfer device with reversing of the sheet; and a controller which executes selectively a first mode, in which one image is formed on one round of the intermediate transfer material, and a second mode in which two images are formed on one round of the intermediate transfer material, wherein the controller effects forming of an image, which should be formed on a sheet refed by the refeed device, on a first half area on one round of the intermediate transfer material, and effects forming of an image, which should be formed on a sheet fed by the feed device, on a second half area on one round of the intermediate transfer material in a case of executing the second mode when performing image formation on both sides of a sheet, wherein the controller executes the first mode before returning to the second mode after executing the first mode instead of executing the second mode when performing image formation on both sides of a sheet, and wherein the controller executes the first mode instead of executing the second mode when formation of an image which should be formed on a sheet which is fed by the feed device is not ready although formation of an image which should be formed on a sheet which is refed by the refeed device is ready.

2. The image forming apparatus according to claim 1, wherein the controller executes the first mode instead of executing the second mode when formation of an image which should be formed on a sheet which is fed by the feed device is not ready because development to image data from page description language takes time.

3. The image forming apparatus according to claim 1, wherein the controller executes the first mode instead of executing the second mode when formation of an image which should be formed on a sheet which is fed by the feed device is not ready because image data transfer takes time because of congestion of traffic on a LAN.

4. The image forming apparatus according to claim 1, wherein the controller executes the first mode instead of executing the second mode when image formation is switched from full color image formation to monochrome image formation between formation of an image which should be formed on a sheet which is refed by the refeed device and formation of an image which should be formed on a sheet which is fed by the feed device.

5. The image forming apparatus according to claim 1, further comprising:

a plurality of developers, each of which forms an image on the photosensitive member; and a shift device which moves any one of the plurality of developers near the photosensitive member, wherein when forming a full color image on a sheet, the controller controls the shift device so as to move the plurality of developers near the photosensitive member by turns, causes an image on the photosensitive member, which is formed by one developer, to be transferred by the first transfer device to the intermediate transfer material, and controls the second transfer device so that an image formed by the plurality of developers is transferred on the intermediate transfer material, and thereafter, the image on the intermediate transfer material may be transferred to a sheet.

6. An image forming apparatus comprising:

a photosensitive member;

an intermediate transfer material;

a first transfer device which transfers on the intermediate transfer material an image formed on the photosensitive member;

a second transfer device which transfers on a sheet the image formed on the intermediate transfer material;

a feed device which feeds the sheet to the second transfer device;

a refeed device which refeeds the sheet, on which the image is transferred by the second transfer device, to the second transfer device with reversing of the sheet; and a controller which executes selectively a first mode, in which one image is formed on one round of the intermediate transfer material, and a second mode in which two images are formed on one round of the intermediate transfer material, wherein the controller effects forming of an image, which should be formed on a sheet refed by the refeed device, on a first half area on one round of the intermediate transfer material, and effects forming of an image, which should be formed on a sheet fed by the feed device, on a second half area on one round of the intermediate transfer material in a case of executing the second mode when performing image formation on both sides of a sheet, wherein the controller executes the first mode before returning to the second mode after executing the first mode instead of executing the second mode when performing image formation on both sides of a sheet, and wherein the controller executes the first mode instead of executing the second mode when processing for image stabilization is performed after formation of an image which should be formed on a sheet which is refed by the refeed device and before formation of an image which should be formed on a sheet which is fed by the feed device.

7. The image forming apparatus according to claim 6, wherein the controller executes the first mode instead of executing the second mode when image density measurement processing is performed.

8. The image forming apparatus according to claim 6, wherein the controller executes the first mode instead of executing the second mode when cleaning processing is performed.

9. The image forming apparatus according to claim 6, wherein the controller executes the first mode instead of executing the second mode when toner residual-quantity detection processing is performed.

* * * * *